United States Patent [19]

Cholin et al.

[11] 4,061,192

[45] Dec. 6, 1977

[54] FIRE EXTINGUISHING AGENT DISTRIBUTING DEVICE

[76] Inventors: John M. Cholin, 143 Polifly Road, Hackensack, N.J. 07601; Rodger R. Cholin, Old Stone Hill Road, Pound Ridge, N.Y. 10576

[21] Appl. No.: 671,575

[22] Filed: Mar. 29, 1976

[51] Int. Cl.[2] ..... A62C 35/00

[52] U.S. Cl. ..... 169/16; 239/489

[58] Field of Search ..... 239/399, 402, 487, 488, 239/489; 169/74, 77, 89, 5, 16

[56] References Cited

U.S. PATENT DOCUMENTS

| | | | |
|---|---|---|---|
| 534,182 | 2/1895 | Stevens | 239/489 X |
| 1,191,621 | 7/1916 | Schmidt | 239/487 |
| 1,311,840 | 7/1919 | Parker | 239/489 X |
| 1,315,765 | 9/1919 | Eckart | 239/489 X |
| 1,748,004 | 2/1930 | Urquhart | 239/489 X |
| 1,748,248 | 2/1930 | Shepherd | 239/489 X |
| 1,784,503 | 12/1930 | Swann | 239/489 X |
| 2,015,395 | 9/1935 | Dray | 239/489 |
| 2,110,409 | 3/1938 | Veach et al. | 239/489 X |
| 2,862,522 | 12/1958 | Yost | 239/487 X |
| 3,889,758 | 6/1975 | Dunn | 169/74 |

FOREIGN PATENT DOCUMENTS

| | | | |
|---|---|---|---|
| 246,590 | 3/1926 | Italy | 239/489 |
| 340,093 | 9/1959 | Switzerland | 239/489 |
| 184,930 | 8/1922 | United Kingdom | 239/487 |

*Primary Examiner*—John J. Love

[57] ABSTRACT

Fire extinguishing agent steering device for high speed fluidic fire extinguishing systems comprising: a conduit having a twisting channel for accomplishing a rotation in the flow of fire extinguishing agent and expellant gas and more particularly a channel with an oblonged or rectangular cross-sectional exit end having its major axis angularly rotated from the major axis of the entrance end; and, an oblonged or rectangular cross-sectional central section interposing the entrance end and the exit end with its major axis gradually increasing angularly from the major axis of the entrance end and the major axis of the exit end, the major axis of the central section coinciding with each of the major axes of the entrance end and the exit end at their respective locations. The entrance end of the device receiving a mixture of fire extinguishing agent and expellant gas which had become disassociated from each other due to a change of direction upstream in the fire extinguishing system, that is, the fire extinguishing agent is accumulated at one end of the oblonged or rectangular section and the gas at the other end. The fire extinguishing agent with the gas is then rotated as it is conveyed through the central section so as to be received at the exit end in the proper orientation to be evenly divided by a tee, downstream of said device.

5 Claims, 8 Drawing Figures

FIRE EXTINGUISHING AGENT DISTRIBUTING DEVICE

BACKGROUND OF THE INVENTION

1. FIELD OF THE INVENTION

In general, the present invention is related to high speed fluidic fire extinguishing devices and more particularly to a device and system for equally distributing fire extinguishing agent with the expellant gas. The fluid is received at unequal cross-sectional density due to a change of direction upstream of the system. The fluid is then rotated and directed into a tee downstream of the system, where it becomes symmetrically divided by the tee thereby producing a equal flow through each leg of the tee.

2. DESCRIPTION OF PRIOR ART

Heretofore, devices were incorporated in fire extinguishing systems which encountered separation of expellant gas and the fire extinguishing agent due to changes in direction of flow upstream of the system. In high speed fluidics, especially when using fire extinguishing agents that are denser than the expellant gas, there is a disassociation of the fire extinguishing agent and the expellant gas due to centrifugal force, as the fluid is propelled around an elbow. To provide for proper distribution of the fire extinguishing agent upon splitting the stream, at a tee, a minimum length of pipe was used between said tee and the elbow at which section the change of direction of flow took place. This produced a design restriction which limited installations since usually there was not enough room to provide for these minimum lengths of pipe as required.

Usually these systems were used in high speed fluidic fire extinguishing equipment installed in food establishments or industrial fire hazards. There is a limited area over a plurality of fire hazards each of which requires at least one fire extinguishing nozzle. To reach these nozzles the system utilized a plurality of elbows and tees. At each elbow the higher density fire extinguishing agent, due to the high speed and centrifugal force, will accumulate at the outer area of the elbow and the expellant gas remained in the inner area, due to the differential of their density. The restriction of space creates difficulties since in field installations of extinguishing systems there is no room to install a run of pipe to accommodate all of the fire nozzles needed to properly deploy the extinguishing agent evenly over the entire hazard.

Further attempts made in providing a "venturi" type pipe section. The non-homogeneous mixture of the fire extinguishing agent and expellant gas coming from a change of direction, as an elbow in a fire extinguishing system, would go into the venturi and be forced back together by the restriction of the venturi orifice. The venturi works on two principles concurrently. First the funnelling down to a smaller diameter will tend to cause the pipe to fill up with the fire extinguishing agent on the threshold of the venturi. Secondly, once the fire extinguishing agent gets to the venturi, its speed is increased. The increase of the speed inside the venturi increases the frictional forces on the fire extinguishing agent and may contribute to its mixing.

There are several difficulties encountered in the use of the venturi. First, although it may minimize the necessity of using a length of pipe between the elbow and the tee it does introduce a significant pressure drop. Second, the amount of restriction inherently necessary in the venturi which is necessary to thoroughly mix the fire extinguishing agent and gas mixture, depends on how full the preceding pipe may be. If the pipe is near the extinguishing system's storage pressure tank it will be full of the fire extinguishing agent and hence a small reduction in the inside diameter of the pipe may be adequate. If the venturi is at the end of several yokes in the system then the pipe will never be completely filled, necessitating greater restriction in the venturi. This will also necessitate the use of different sized venturies making installing more laborious and expensive. Since the fire extinguishing agent's extinguishing ability is directly proportional to the flow rate, any resulting lengthening of time of discharge, because of diameter restrictions, reduces extinguishing potential.

The present invention solves these problems and specifically the space problem to a large extent by eliminating the necessity of using any length of pipe between the elbows and the tees. Secondly, it does not create pressure drops, therefore, the present invention will permit more flexibility in the use of extra length of pipe for producing a more efficient fire extinguishing system. Proper distribution is developed by a rotation of the fire extinguishing agent and expellant gas by the steering device so that an equal proportion of the fire extinguishing agent and expellant gas travels through each leg of the tee.

SUMMARY

The present invention contemplates a fire extinguishing agent steering device for equally dividing disassociated fire extinguishing agent and expellant gas equally in two directions in a high speed fluidic fire extinguishing system. The invention provides a rotation of the fluidic flow by means of the steering device. This device will take a disassociated flow which is directed from an elbow and will rotate it without the flow losing it momentum such that the disproportionate stream of chemical and gas is presented to the tee in a symmetrical orientation with respect to the tee. In addition, one object of this invention is to provide a fire extinguishing agent steering device for assuring properly oriented mixture of chemical and gas when it arrives at the receiving end of the nozzle of a fire extinguishing system.

Another object of this invention is to eliminate the need of a required pipe length necessary before a tee in a fire extinguishing system.

A further object of this invention is to provide a more equal distribution fire extinguishing agent and expellant gas so as to provide equal flow distribution between two legs of a tee downstream in the fire extinguishing system.

These and other objects and features of the invention are pointed out in the following description in terms of the embodiments thereof which are shown in the accompanying drawing. It is to be understood, however that the drawing is for the purpose of illustration only and is not a definition of the limits of the invention.

DESCRIPTION OF THE PREFERRED EMBODIMENT OF THE INVENTION

Figure 1:
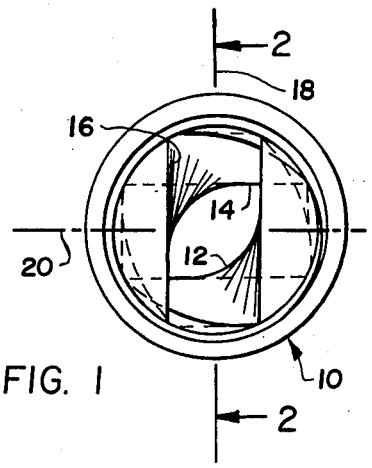
FIG. 1 is an end view of a fire extinguishing agent steering device, utilized in a fire extinguishing system in accordance with a preferred embodiment of the invention showing one type of cross-sectional entrance end and exit end.
Figure 2:
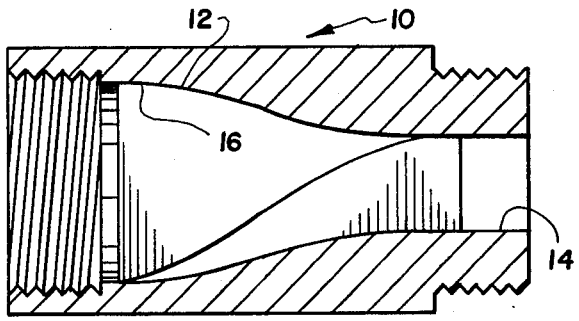
FIG. 2 is a side sectional view of the distributing device taken along line 2—2 of FIG. 1.
Figure 3:
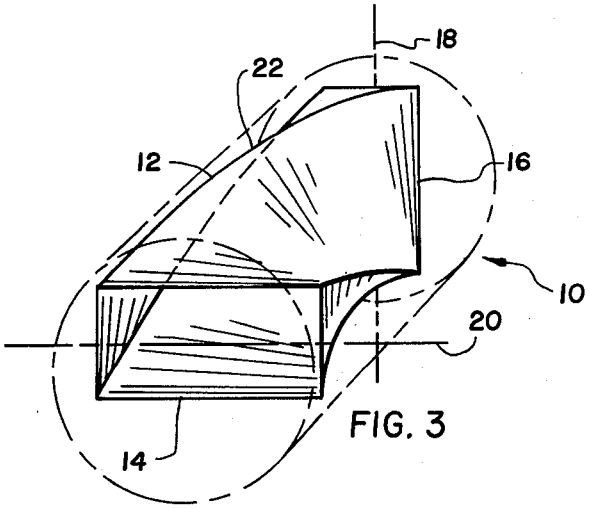
FIG. 3 is a perspective view of the twisting channel section of the device of FIG. 1.

Referring to the drawing a fire extinguishing agent steering device 10 for high speed fire extinguishing systems is basically comprised of a conduit having a helical channel 12 with an oblonged or rectangular horizontally extending cross-section entrance end 14, an oblonged or rectangular vertically extending cross-sectional exit end 16 having its major axis 18 angularly rotated from a major axis 20 of the entrance end 14, and an oblonged or rectangular cross-sectional central section 22 interposing the entrance end 14 and the exit end 16 with its major axis gradually increasing angularly from the major axis 20 of the entrance end 14 to the major axis 18 of the exit end 16 and coinsiding with each of the major axes at the respective locations. The agent steering device is located upstream of a change of flow means, for example a pipe tee or an outlet nozzle.

Figure 7:
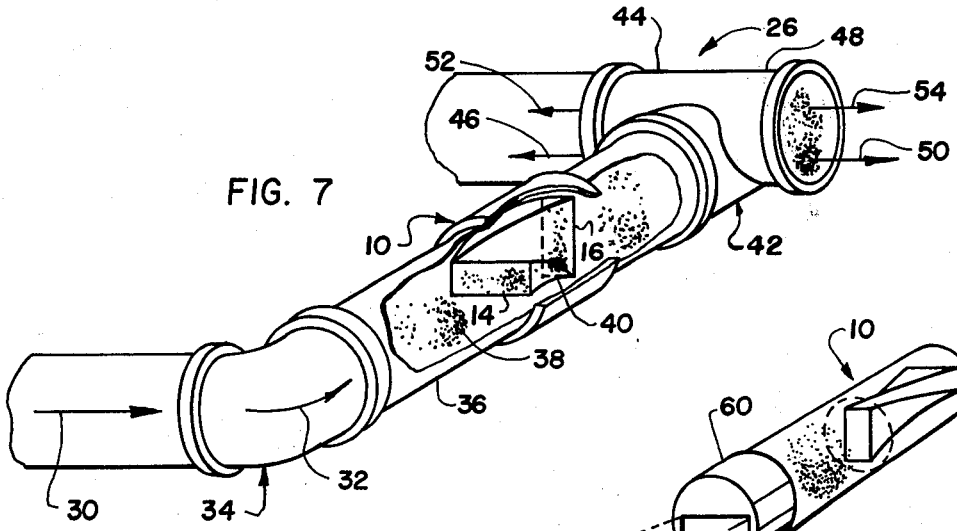
FIG. 7 is a perspective view of the fire extinguishing agent steering device as incorporated in a part of the fire extinguishing system.

Referring to FIG. 7 of the drawing, the fire extinguishing agent distributing device 10 is shown installed in a portion of a high speed fluidic fire extinguishing system 26. The system using fire extinguishing agent and expellant gas is shown with the fluid directed from a linear direction as shown by arrow 30 to a changing direction as shown by arrow 32 due to an elbow 34. Since the fluid is traveling at high speeds centrifugal force will drive the more dense fire extinguishing agent toward the outside of the elbow 32 so that when it is propelled through a section of pipe 36 the fire extinguishing agent will accumulate on the right side section 38 of the pipe 36 as viewed in FIG. 7.

The fire extinguishing agent at section 38 will enter the entrance end 14 of the steering device 10 still in a disassociated condition and will be rotated by the twisting channel 12 to be expelled with the expellant gas into the subsequent tee 42. The fire extinguishing agent will be expelled at the lower section 40 of the exit end 16 of the steering device 10. The fire extinguishing agent will then be directed to a tee 42 to be conveyed therethrough with substantially half of the agent going through leg 44 of the tee 42, as shown by arrow 46 and half through leg 48 of tee 42, as shown by arrow 50. At the same time the expellant gas will be equally devided through leg 44 and 48 as shown by arrows 52 and 54 respectively.

Figure 4:
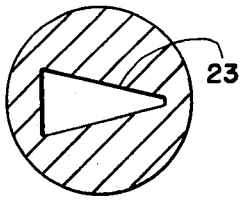
FIG. 4 is another cross-sectional entrance end with the exit end being the same cross-sectional configuration but with its major axis at a different angle than that of the entrance end.
Figure 5:
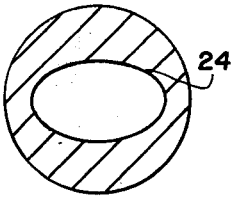
FIG. 5 is still another cross-sectional entrance end with the exit end being the same cross-sectional configuration but with its major axis at a different angle than that of the entrance end.
Figure 6:
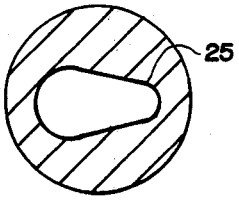
FIG. 6 is a further type cross-sectional entrance end with the exit end being the same cross-sectional configuration but with its major axis at a different angle than that of the entrance end.

It should also be understood that the cross-section of the entrance end and exit end of the twisting channel 12 can be an elongated triangle 23 shown in FIG. 4, a ellipse 24 shown in FIG. 5 or pear shaped 25 shown in FIG. 6.

It should be noted then as shown in FIG. 7 that the fire extinguishing agent density is greatest at the outside of the elbow 34 and the steering device 10 receives it on the right hand side as shown in FIG. 7 to be twisted 90° therethrough and received symmetrically at the tee 42 to be equally distributed between the two legs 44 and 48. It must be noted that the 90° twist in the invention is not intended to impart any rotational momentum to the extinguishant-expellant gas mixture but is intended to merely reorient the non-homogeneous mixture so that it impinges upon a dividing device such as a tee symmetrically with respect to said dividing device. This will insure equal distribution of the powder and the gas to fire extinguishing nozzles downstream of each leg of the tee.

Figure 8:
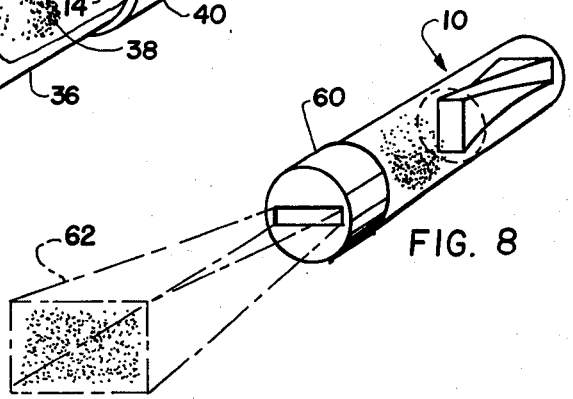
FIG. 8 is a perspective view showing another embodiment of the invention of FIG. 1 wherein the fire extinguishing agent steering device is located prior to each fire extinguishing nozzle.

Referring to FIG. 8, the fire extinguishing agent steering device 10 would also be useful just prior to a nozzle 60 where it would reorient the powder stream which is unevenly distributed in the preceding length of pipe to an orientation that is symmetrical with respect to the nozzle. Hence the nozzle, distribute the fire extinguishing agent as shown by phantom lines 62.

Therefore as outlined before in fire extinguishing systems it is absolutely necessary to deploy the extinguishant evenly over the entire hazard. Hence, no matter where the fire exists within that hazard, it will be extinguished. The extinguishing agent is spread out across the hazard by means of a piping yokes and nozzles.

The "horvert" would be placed prior to each tee so that the extinguishing agent would be divided evenly down each side of the yoke. However, the nozzle must also receive the extinguishant/expellant mix in a symmetrical orientation; otherwise, one area in the hazard will receive less extinguishing agent than adequate to extinguish the fire.

While the present invention has been described in preferred embodiments, it will be obvious to those skilled in the art that various modifications can be made therein within the scope of the invention.

What is claimed is:

1. A fire extinguishing agent steering device for high speed fluidic fire extinguishing systems for extinguishing a fire hazard comprised of a change of flow means, a conduit upstream of said change of flow means having a twisted channel for reorienting the flow of fire extinguishing agent and expellant gas to assure equal division of the flow into said change of flow means thereby provide homogeneous fire extinguishing agent distribution at the fire hazard, said conduit having said channel with an oblonged cross-sectional exit end, having its major axis angularly rotated from the major axis of the entrance end; and, an oblonged cross-sectional central section interposing the entrance end and the exit end with its major gradually increasing angularly from the major axis of the entrance end and the major axis of the exit end, the major axis of the central section coinciding with each of the major axes of the entrance end and the exit end at their respective locations.

2. A device according to claim 1 wherein said entrance end and said exit end are of rectangular cross-section.

3. A device according to claim 1 wherein said entrance end and said exit end are of triangular cross-section.

4. A device according to claim 1 wherein said entrance end and said exit end are of elliptical cross-section.

5. A device according to claim 1 wherein said entrance end and said exit end are of pear shape cross-section.

* * * * *